US011512407B2

(12) United States Patent
Zhang et al.

(10) Patent No.: US 11,512,407 B2
(45) Date of Patent: Nov. 29, 2022

(54) METHOD AND DEVICE FOR LASER-ASSISTED ELECTROCHEMICAL COMPOSITE DEPOSITION USING RIFLING-TYPE HOLLOW ROTATING ELECTRODE

(71) Applicant: Jiangsu University, Jiangsu (CN)

(72) Inventors: Zhaoyang Zhang, Jiangsu (CN); Yucheng Wu, Jiangsu (CN); Kun Xu, Jiangsu (CN); Xueren Dai, Jiangsu (CN); Shuai Yang, Jiangsu (CN); Sheng Guo, Jiangsu (CN); Douyan Zhao, Jiangsu (CN)

(73) Assignee: Jiangsu University, Jiangsu (CN)

( * ) Notice: Subject to any disclaimer, the term of this patent is extended or adjusted under 35 U.S.C. 154(b) by 0 days.

(21) Appl. No.: 17/617,005

(22) PCT Filed: Jul. 12, 2021

(86) PCT No.: PCT/CN2021/105776
§ 371 (c)(1),
(2) Date: Dec. 7, 2021

(87) PCT Pub. No.: WO2022/037315
PCT Pub. Date: Feb. 24, 2022

(65) Prior Publication Data

US 2022/0307150 A1 Sep. 29, 2022

(30) Foreign Application Priority Data

Aug. 18, 2020 (CN) ..... 202010832204.7

(51) Int. Cl.
*C25D 5/18* (2006.01)
*C25D 5/02* (2006.01)
(Continued)

(52) U.S. Cl.
CPC ..... *C25D 5/18* (2013.01); *C25D 5/024* (2013.01); *C25D 13/00* (2013.01); *C25D 17/12* (2013.01)

(58) Field of Classification Search
CPC ..... C25D 17/12; C25D 5/024; C25D 5/013
See application file for complete search history.

(56) References Cited

U.S. PATENT DOCUMENTS 11,306,408 B2 * 4/2022 Zhang ..... C25D 21/10
2016/0016336 A1 1/2016 Hess et al.

FOREIGN PATENT DOCUMENTS

CN 103590076 2/2014
CN 105568348 5/2016
(Continued)

OTHER PUBLICATIONS

"International Search Report (Form PCT/ISA/210) of PCT/CN2021/105776," dated Sep. 28, 2021, pp. 1-4.
(Continued)

*Primary Examiner* — Brian W Cohen
(74) *Attorney, Agent, or Firm* — JCIP Global Inc.

(57) ABSTRACT

The present invention discloses a method and a device for laser-assisted electrochemical composite deposition using a rifling-type hollow rotating electrode, which relate to the field of micro-composite processing in special processing technologies. A center of a laser beam is allowed to pass through a rifling-type hollow rotating electrode and focus onto a cathode substrate. When the rifling-type hollow rotating electrode is rotated at a constant speed, an electrodeposition solution rotates in the rifling-type hollow rotating electrode and generates a certain centripetal force to improve the precision and localization of deposition. During the process of the present invention, an internal rifling structure of the electrode is rotated at a high speed so that the deposition solution generates a centripetal force. The inter-
(Continued)

nal rifling structure and an external helical structure of the rifling-type hollow rotating electrode make the deposition solution move upward to form a "self-circulation" system.

9 Claims, 2 Drawing Sheets

(51) Int. Cl.
*C25D 13/00* (2006.01)
*C25D 17/12* (2006.01)

(56) References Cited

FOREIGN PATENT DOCUMENTS

| | | |
|---|---|---|
| CN | 106757285 | 5/2017 |
| CN | 107937939 | 4/2018 |
| CN | 108103541 | 6/2018 |
| CN | 110528054 | 12/2019 |
| CN | 112126955 | 12/2020 |
| RU | 2063484 | 7/1996 |

OTHER PUBLICATIONS

"Written Opinion of the International Searching Authority (Form PCT/ISA/237) of PCT/CN2021/105776," dated Sep. 28, 2021, pp. 1-5.

* cited by examiner

METHOD AND DEVICE FOR LASER-ASSISTED ELECTROCHEMICAL COMPOSITE DEPOSITION USING RIFLING-TYPE HOLLOW ROTATING ELECTRODE

CROSS-REFERENCE TO RELATED APPLICATION

This application is a 371 of international application of PCT application serial no. PCT/CN2021/105776, filed on Jul. 12, 2021 which claims the priority benefit of China application no. 202010832204.7, filed on Aug. 18, 2020. The entirety of each of the above mentioned patent applications is hereby incorporated by reference herein and made a part of this specification.

TECHNICAL FIELD

The present invention relates to the field of micro-composite processing in special processing technologies, and particularly to a method and a device for laser-assisted electrochemical composite deposition using a rifling-type hollow rotating electrode, which are suitable for localized electrodeposition and processing of high-performance composite coatings.

DESCRIPTION OF RELATED ART

The localized electrodeposition technology is employed to carry out an electrochemical reaction by using a strong electric field generated between an anode tip and a cathode substrate. Structures of different shapes can thus be deposited at any position on cathode substrates of materials such as metal or semiconductors. This technology is applicable in automotive, aerospace, medical, and other fields, but has problems that it is difficult to control precision and defects such as pores and protrusions exist. Therefore, it is an effective way to solve the problems by introducing a composite energy field into an electrodeposition system. Laser processing is a non-contact processing method and has advantages such as high energy density, high efficiency, and good flexibility. The introduction of laser irradiation into the electrodeposition system can raise the cathode potential and increase the limiting current density by using the thermal effect of laser, thereby realizing localized deposition guided by laser irradiation.

A composite coating containing nanoparticles has better wear resistance, corrosion resistance, and other properties than a single coating, and thus has good development and application prospects. However, in the preliminary preparation of a composite deposition solution, the particles need to be uniformly dispersed in the deposition solution, and the solution must be stirred to keep the particles in suspension during the deposition process. Particle agglomeration will degrade the performance of the coating, and how to effectively avoid particle agglomeration during the deposition process is critical to composite deposition.

Scholars at home and abroad have conducted certain researches on the localized electrodeposition technology. It is proposed in Chinese Patent publication No. CN108103541A entitled "Three-dimensional Metal Additive Manufacturing Device And Method", which discloses that two rows of film layers are stacked on a cathode substrate by using film forming nozzles and a jet nozzle sprays an electrolyte onto the area between the two rows of film layers on the surface of the cathode substrate. Therefore, a metal layer is obtained by localized electrodeposition, and by lifting up the nozzles, the film layers and the metal layers are continuously stacked to realize additive manufacturing of a three-dimensional metal component. The operation of the invention is rather complicated, the surface quality of the material is affected when the film layers are removed, and the surface forming precision of a complex shape obtained by deposition is low.

Scholars at home and abroad have conducted preliminary studies on the problem of easy agglomeration of particles during the composite deposition process. It is proposed in Chinese Patent publication No. CN105568348A entitled "Method For Assisting Composite Plating With Magnetic Field". According to the method, magnetic iron sesquioxide particles of a core-shell structure are ultrasonically dispersed in a plating solution. Under the effect of an external magnetic field, the core-shell structured magnetic particles dispersed in the plating solution are adsorbed on the surface of a cathode. When a current is applied in the electroplating system, the core-shell structured magnetic particles adsorbed on the cathode are gradually compounded into a metal coating as the thickness of the deposited metal layer increases, and thus a composite coating is formed. In this method, the core-shell structured magnetic particles are difficult to fabricate and certain application limitations exist.

SUMMARY

To eliminate the defects in the prior art, the present invention provides a method for laser-assisted electrochemical composite deposition using a rifling-type hollow rotating electrode. During the process, the rifling-type hollow rotating electrode is rotated at a constant speed and a centripetal force is generated, which improves the precision of localized deposition, keeps nanoparticles in suspension to achieve higher uniformity of dispersion, and forms "self-circulation" of the solution to suppress the concentration polarization and improve the quality of the deposited layer.

The present invention further provides a device for laser-assisted electrochemical composite deposition using a rifling-type hollow rotating electrode. This device can be used to implement the above method.

The present invention achieves the above objectives through the following technical solutions.

A method for laser-assisted electrochemical composite deposition using a rifling-type hollow rotating electrode includes the following steps. Arranging a rifling-type hollow rotating electrode and a cathode substrate in a working tank, and connecting the rifling-type hollow rotating electrode and the cathode substrate to a positive electrode and a negative electrode of an electrochemical power supply, respectively. Allowing a center of a laser beam to pass through the rifling-type hollow rotating electrode and focus onto the cathode substrate. Rotating the rifling-type hollow rotating electrode at a constant speed, whereby an electrodeposition solution rotates in the rifling-type hollow rotating electrode and generates a certain centripetal force to improve precision and localization of deposition.

Further, the electrodeposition solution contains nanoparticles.

Further, the rifling-type hollow rotating electrode is an insoluble hollow anode tube and is resistant to high temperature, acid, and alkali and externally insulated.

A device for laser-assisted electrochemical composite deposition using a rifling-type hollow rotating electrode includes a laser processing system, an electrochemical processing system, and a control system. The laser processing system includes a pulsed laser, a reflector, and a focusing lens. The reflector is arranged in a horizontal direction of the pulsed laser, and the focusing lens is arranged directly below the reflector. A laser beam is aligned with a center of a rifling-type hollow rotating electrode and is focused onto an upper surface of a workpiece. The electrochemical processing system includes an electrochemical power supply, the rifling-type hollow rotating electrode, and a cathode substrate. A positive electrode of the electrochemical power supply is connected to the rifling-type hollow rotating electrode and a negative electrode of the electrochemical power supply is connected to the cathode substrate. The rifling-type hollow rotating electrode is located directly above the cathode substrate with a certain initial gap in between. The control system includes a computer, a control cabinet, an X-Y-Z workbench, and a numerical control platform; the computer is connected to the control cabinet and the pulsed laser via connection ports. The control cabinet is connected to the numerical control platform and the X-Y-Z workbench.

Further, the rifling-type hollow rotating electrode has an internal rifling structure and an external helical structure, and the internal rifling structure is in a direction opposite to a helical direction of the external helical structure.

Further, the initial gap between the rifling-type hollow rotating electrode and the cathode substrate is 20 μm-30 μm.

Further, a square hole is provided on the rifling-type hollow rotating electrode, and an electrodeposition solution enters the rifling-type hollow rotating electrode through the square hole.

Further, the rifling-type hollow rotating electrode is rotated at a speed of 500 r/min-1000 r/min.

Further, the pulsed laser generates a laser beam with a diameter smaller than an inner diameter of the rifling-type hollow rotating electrode. The pulsed laser has a wavelength of 1064 nm, a frequency of 1 Hz-100 Hz, and single pulse energy of 100 mJ-200 mJ.

Further, the electrochemical power supply is a pulse power supply with a voltage of 0-20V, a frequency of 1 kHz-2 MHz, and a duty cycle of 0-100%.

The present invention has the following technical advantages and beneficial effects.

1. When the rifling-type hollow rotating electrode is rotated at a constant speed during the process, the deposition solution generates a centripetal force to improve the localization precision.

2. The particles are kept in suspension during the deposition process due to the internal rifling structure of the rifling-type hollow rotating electrode, so that much higher uniformity of dispersion is achieved, the preparation time of the composite deposition solution is saved, and the deposition efficiency is greatly improved.

3. The internal rifling structure and the external helical structure of the rifling-type hollow rotating electrode are in opposite directions, so that the deposition solution forms a "self-circulation" system, which can remove air bubbles in time, suppress concentration polarization, and improve the quality of the deposited layer.

4. Laser irradiation can accelerate the reaction in the processing area, and the formed micro-region stirring can also suppress concentration polarization, remove air bubbles, and improve the uniformity of deposition, thereby improving the quality of the deposited layer.

DESCRIPTION OF THE EMBODIMENTS

Embodiments of the present invention are described in detail below and are exemplified in the accompanying drawings, wherein the same or similar reference signs indicate the same or similar elements or elements with the same or similar functions. The embodiments described below with reference to the accompanying drawings are exemplary and are intended to explain the present invention, instead of limiting the present invention.

In the description of the present invention, it should be understood that terms such as "central", "longitudinal", "transverse", "length", "width", "thickness", "upper", "lower", "axial", "radial", "vertical", "horizontal", "inner", and "outer" indicate directional or positional relationships based on the accompanying drawings. They are merely used for the convenience and simplicity of the description of the present invention, instead of indicating or implying that the demonstrated device or element is located in a specific direction or is constructed and operated in a specific direction. Therefore, they cannot be construed as limitations to the present invention.

In the present invention, unless otherwise expressly specified and defined, terms such as "mounted", "interconnected", "connected", and "fixed" should be understood in a broad sense. For example, they may be fixed connections, detachable connections, or integral connections; may be mechanical connections or electrical connections; may be direct connections or indirect connections through an intermediate medium; and may be internal communications between two elements. The specific meanings of the above terms in the present invention can be understood by persons of ordinary skill in the art according to specific situations.

Figure 1:
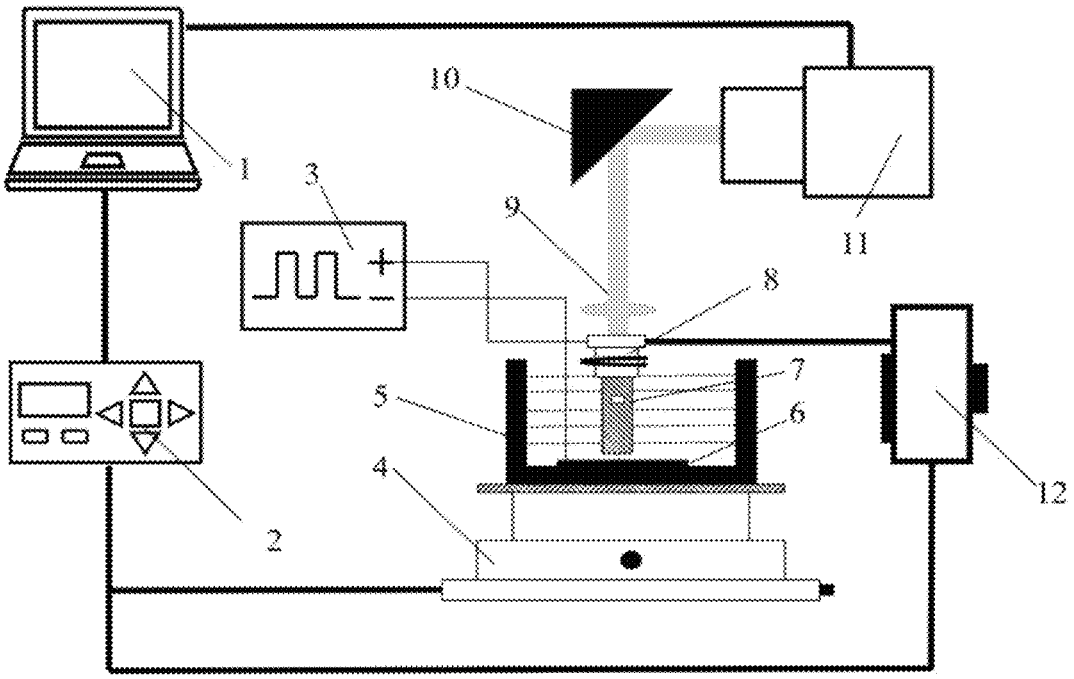
FIG. 1 is a schematic structural diagram of a device for laser-assisted electrochemical composite deposition using a rifling-type hollow rotating electrode according to an embodiment of the present invention.

Referring to FIG. 1, a device for laser-assisted electrochemical composite deposition using a rifling-type hollow rotating electrode includes a laser processing system, an electrochemical processing system, and a control system. The laser processing system includes a pulsed laser 11, a reflector 10, and a focusing lens 9. The reflector 10 is arranged in the horizontal direction of the pulsed laser 11, and the focusing lens 9 is arranged directly below the reflector 10. The center of a laser beam is aligned with the center of a rifling-type hollow rotating electrode 7, and the laser beam is allowed to pass through the electrode and focus onto an upper surface of a workpiece.

The electrochemical processing system includes an electrochemical power supply 3, the rifling-type hollow rotating electrode 7, and a cathode substrate 6. A positive electrode of the electrochemical power supply 3 is connected to the rifling-type hollow rotating electrode 7 and a negative electrode of the electrochemical power supply 3 is connected to the cathode substrate 6. The rifling-type hollow rotating electrode 7 is located directly above the cathode substrate 6 with a certain initial gap in between. The initial gap between the rifling-type hollow rotating electrode 7 and the cathode substrate 6 is 20 μm-30 μm.

The initial gap is a gap between the rifling-type hollow rotating electrode 7 and the cathode substrate 6 before deposition. With the increase of the height of the deposit, the gap between the rifling-type hollow rotating electrode 7 and the deposit on the cathode substrate 6 is reduced during the deposition process. Therefore, a numerical control platform 12 is used to keep the gap between the rifling-type hollow rotating electrode 7 and the cathode substrate 6 according to the desired thickness of the deposited layer. That is, a gap exists between the rifling-type hollow rotating electrode 7 and the cathode substrate 6, ensuring that the obtained deposited layer and the rifling-type hollow rotating electrode 7 are not in contact.

The control system includes a computer 1, a control cabinet 2, an X-Y-Z workbench 4, and the numerical control platform 12. The computer 1 is connected to the control cabinet 2 and the pulsed laser 11 via connection ports. The control cabinet 2 is connected to the numerical control platform 12 and the X-Y-Z workbench 4.

The rifling-type hollow rotating electrode 7 is an insoluble anode tube and is resistant to high temperature, acid, and alkali and externally insulated. The initial processing gap between the electrode and the cathode substrate 6 is 20 μm-30 μm. The electrode has an internal rifling structure and an external helical structure and has an inner diameter of 2 mm-5 mm. A square hole is provided on the outer side of the electrode to allow in a deposition solution. The electrode is rotated stably at a speed of 500 r/min-1000 r/min during processing. The pulsed laser 11 has a wavelength of 1064 nm, a frequency of 1 Hz-100 Hz, and single pulse energy of 100 mJ-200 mJ and generates a beam with a diameter smaller than the inner diameter of the rifling-type hollow rotating electrode 7. The electrochemical power supply 3 is a pulse power supply with a voltage of 0-20V, a frequency of 1 kHz-2 MHz, and a duty cycle of 0-100%.

During the process of the present invention, when the internal rifling structure of the electrode is rotated at a high speed, the deposition solution generates a centripetal force, which improves the localization precision and keeps particles in suspension during the deposition process to achieve much higher uniformity of dispersion. The internal rifling structure and the external helical structure of the rifling-type hollow rotating electrode make the deposition solution move upward to form a "self-circulation" system, which can remove air bubbles in time, suppress concentration polarization, and improve the quality of the deposited layer. Laser irradiation can accelerate the reaction in the processing area, and the formed micro-region stirring can also suppress concentration polarization, remove air bubbles, and improve the uniformity of deposition, thereby improving the quality of the deposited layer. The present invention is suitable for localized electrodeposition and processing of high-performance composite coatings and is applicable in medical, electronics, aerospace, and other micro-manufacturing and processing fields.

Figure 2A:
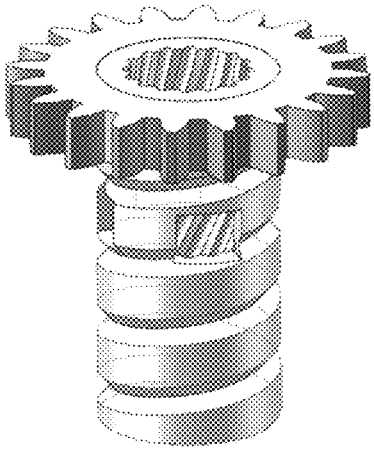
FIG. 2*a* is a structural side view of a rifling-type hollow rotating electrode.
Figure 2B:
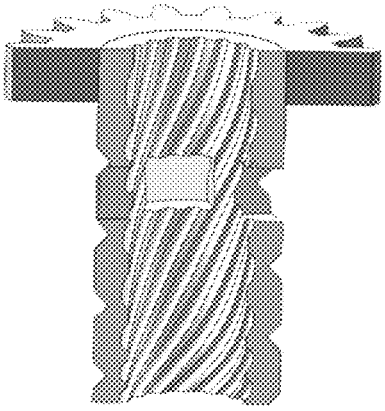
FIG. 2*b* is a structural sectional view of the rifling-type hollow rotating electrode.
Figure 2C:
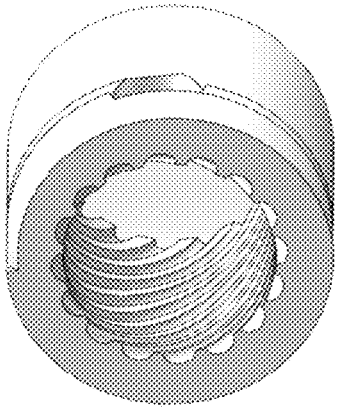
FIG. 2*c* is a structural top view of the rifling-type hollow rotating electrode.

Referring to schematic structural diagrams of the rifling-type hollow rotating electrode 7, FIG. 2*a* shows the external helical structure with the square hole of the rifling-type hollow rotating electrode 7, FIG. 2*b* shows the internal rifling structure of the electrode in a direction opposite to the external helical direction, and FIG. 2*c* is a top view of the rifling-type hollow rotating electrode 7. The deposition solution inside the electrode moves in an opposite direction with respect to that surrounding the electrode.

A method for laser-assisted electrochemical composite deposition using a rifling-type hollow rotating electrode includes the following steps. The substrate is pretreated, and after pretreatment such as grinding, polishing, and ultrasonic cleaning, the cathode substrate 6 is placed in a working tank 5. The processing position is determined, wherein the rifling-type hollow rotating electrode 7 is held by a special clamp 8 and reaches a processing position with a certain initial gap from the cathode substrate 6 through adjustment of the numerical control platform 12. The laser beam is focused, wherein the laser processing system is adjusted to make the center of the laser beam aligned with the center of the rifling-type hollow rotating electrode 7, and the laser beam is focused onto the surface of the cathode substrate 6. The electrode is rotated, where after the deposition solution is poured in, the external square hole of the rifling-type hollow rotating electrode 7 is immersed in the deposition solution, and the electrode is kept rotating stably at a constant speed. The processing starts. When the rifling-type hollow rotating electrode 7 is rotated at a constant speed, due to the internal rifling structure of the electrode, the deposition solution is pushed downward and generates a certain centripetal force to improve the precision and localization of deposition. Laser irradiation can accelerate the reaction in the processing area, and the formed micro-region stirring can also suppress concentration polarization, remove air bubbles, and improve the uniformity of deposition, thereby improving the quality of the deposited layer. When the deposition solution contains substances such as nanoparticles, the deposition solution will rotate at a constant speed in the rifling-type hollow rotating electrode 7, which can reduce the agglomeration phenomenon and greatly improve the uniformity of dispersion of the nanoparticles. When the rifling-type hollow rotating electrode 7 is rotated at a constant speed, the deposition solution surrounding the electrode will rise upward to form a "self-circulation" system, which can suppress concentration polarization and improve the quality of the deposited layer.

In this specification, descriptions with reference to the terms "one embodiment", "some embodiments", "examples", "specific examples", "some examples" and the like denote that the specific features, structures, materials, or characteristics illustrated by the embodiments or examples are incorporated in at least one embodiment or example of the present invention. In this specification, the schematic statements of the above terms do not necessarily mean the same embodiments or examples. Moreover, the illustrated specific features, structures, materials, or characteristics can be properly combined in any one or more embodiments or examples.

Although the embodiments of the present invention have been shown and described, it can be understood that the above embodiments are exemplary and shall not be construed as limitations to the present invention. Changes, modifications, replacements, and variations can be made to these embodiments within the scope of the present invention by persons of ordinary skill in the art without departing from the principle and purpose of the present invention.

What is claimed is:

1. A method for laser-assisted electrochemical composite deposition using a rifling-type hollow rotating electrode, the method comprising the following steps:

arranging a rifling-type hollow rotating electrode and a cathode substrate in a working tank, and connecting the rifling-type hollow rotating electrode and the cathode substrate to a positive electrode and a negative electrode of an electrochemical power supply, respectively;

allowing a center of a laser beam to pass through the rifling-type hollow rotating electrode and focus onto the cathode substrate; and rotating the rifling-type hollow rotating electrode at a constant speed, whereby an electrodeposition solution rotates in the rifling-type hollow rotating electrode and generates a certain centripetal force to improve precision and localization of a deposition, wherein the rifling-type hollow rotating electrode has an internal rifling structure and an external helical structure, and the internal rifling structure is in a direction opposite to a helical direction of the external helical structure.

2. The method for the laser-assisted electrochemical composite deposition using the rifling-type hollow rotating electrode according to claim 1, wherein the electrodeposition solution contains nanoparticles.

3. The method for the laser-assisted electrochemical composite deposition using the rifling-type hollow rotating electrode according to claim 1, wherein the rifling-type hollow rotating electrode is an insoluble hollow anode tube and is resistant to high temperature, acid, and alkali and externally insulated.

4. A device for laser-assisted electrochemical composite deposition using a rifling-type hollow rotating electrode, the device comprising a laser processing system, an electrochemical processing system, and a control system;

wherein the laser processing system comprises a pulsed laser, a reflector, and a focusing lens; the reflector is arranged in a horizontal direction of the pulsed laser, and the focusing lens is arranged directly below the reflector; a laser beam is aligned with a center of a rifling-type hollow rotating electrode and is focused onto an upper surface of a workpiece;

the electrochemical processing system comprises an electrochemical power supply, the rifling-type hollow rotating electrode, and a cathode substrate; a positive electrode of the electrochemical power supply (3) is connected to the rifling-type hollow rotating electrode and a negative electrode of the electrochemical power supply is connected to the cathode substrate; the rifling-type hollow rotating electrode is located directly above the cathode substrate with a certain initial gap in between;

the control system comprises a computer, a control cabinet, an X-Y-Z workbench, and a numerical control platform; the computer is connected to the control cabinet and the pulsed laser via connection ports; the control cabinet is connected to the numerical control platform and the X-Y-Z workbench; the rifling-type hollow rotating electrode has an internal rifling structure and an external helical structure, and the internal rifling structure is in a direction opposite to a helical direction of the external helical structure.

5. The device for the laser-assisted electrochemical composite deposition using the rifling-type hollow rotating electrode according to claim 4, characterized in that wherein the initial gap between the rifling-type hollow rotating electrode and the cathode substrate is 20 μm-30 μm.

6. The device for the laser-assisted electrochemical composite deposition using the rifling-type hollow rotating electrode according to claim 4, wherein a square hole is provided on the rifling-type hollow rotating electrode, and an electrodeposition solution enters the rifling-type hollow rotating electrode through the square hole.

7. The device for the laser-assisted electrochemical composite deposition using the rifling-type hollow rotating electrode according to claim 4, wherein the rifling-type hollow rotating electrode is rotated at a speed of 500r/min-1000r/min.

8. The device for the laser-assisted electrochemical composite deposition using the rifling-type hollow rotating electrode according to claim 4, wherein the pulsed laser generates a laser beam with a diameter smaller than an inner diameter of the rifling-type hollow rotating electrode; the pulsed laser has a wavelength of 1064 nm, a frequency of 1 Hz-100 Hz, and single pulse energy of 100 mJ-200 mJ.

9. The device for the laser-assisted electrochemical composite deposition using the rifling-type hollow rotating electrode according to claim 4, wherein the electrochemical power supply is a pulse power supply with a voltage of 0-20V, a frequency of 1 kHz-2 MHz, and a duty cycle of 0-100%.

* * * * *